US005961873A

United States Patent [19]

Keller

[11] Patent Number: 5,961,873

[45] Date of Patent: Oct. 5, 1999

[54] SLIDING GATE VALVE ASSEMBLY FOR USE WITH A VESSEL CONTAINING MOLTEN METAL

[75] Inventor: Werner Keller, Steinhausen, Switzerland

[73] Assignee: Stoping AG, Baar, Switzerland

[21] Appl. No.: 09/116,223

[22] Filed: Jul. 16, 1998

[30] Foreign Application Priority Data

Jul. 16, 1997 [CH] Switzerland ..... 1739/97

[51] Int. Cl.[6] ..... B22D 41/08

[52] U.S. Cl. ..... 222/600; 266/236

[58] Field of Search ..... 222/597, 600; 266/236

[56] References Cited

U.S. PATENT DOCUMENTS

| | | | |
|---|---|---|---|
| 4,660,749 | 4/1987 | Yoki et al. | 222/600 |
| 5,141,139 | 8/1992 | Kleeblatt | 222/600 |
| 5,170,915 | 12/1992 | Szadkowski | 222/600 |
| 5,421,563 | 6/1995 | Holtermann et al. | 222/600 |
| 5,836,485 | 11/1998 | Plattner et al. | 222/600 |

*Primary Examiner*—Scott Kastler

*Attorney, Agent, or Firm*—Wenderoth, Lind & Ponack, L.L.P.

[57] ABSTRACT

A sliding gate valve for a vessel containing molten metal is provided which includes a housing and a lid pivotally mounted thereon. A sliding plate is sandwiched between two fixed plates and the three are received within the housing. Clamping elements are provided and are used in conjunction with the lid to secure the plates. A lock is provided to prevent movement of the lid in a direction parallel to movement of the sliding plate while allowing movement of the lid in a direction perpendicular to movement of the sliding plate. The lock is designed to assume a locked position whenever the sliding gate valve is mounted onto the vessel.

28 Claims, 2 Drawing Sheets

SLIDING GATE VALVE ASSEMBLY FOR USE WITH A VESSEL CONTAINING MOLTEN METAL

BACKGROUND OF THE INVENTION

The present invention relates to a pouring device for a steel or molten metal container. More particularly, the present invention relates to a sliding gate valve assembly having a sliding plate and lid in which the sliding plate slides between an open and a closed position to control the flow of molten metal and in which the lid may be locked and hence prevented from moving in a direction parallel to movement of the sliding plate while remaining free to expand in a direction perpendicular to movement of the sliding plate.

Typical sliding gate valve assemblies include a moveable sliding plate sandwiched between two fixed plates. The three plates each contain an aperture or flow opening which are coaxially aligned when the assembly is in an open state. The fixed plates are generally immobilized by a lid or a screw mechanism and the entire assembly is mounted to the underside, coaxially with a pouring opening, of a molten metal container. The sliding plate may then be used to open and close flow from the vessel through the valve assembly.

In U.S. Pat. No. 5,170,915 to Szadkowski, a sliding gate valve is disclosed which has a sliding plate sandwiched between a fixed upper plate and a fixed lower plate. A ring or a lid is used to press or lock the plates together. The lid is stabilized against movement in a direction parallel to movement of the sliding plate by a screw which acts as a locking or clamping device. A disadvantage of this device is that the locking screw tends to come loose as a result of the opening and closing movement of the sliding plate. Additionally, the lid of the Szadkowski device is fixed against vertical movement and thus is unable to compensate for thermal expansion occurring perpendicular to the direction of the movement of the sliding plate.

Hence, a need in the art exists for a sliding gate valve having a lid which may be reliably fixed against movement in a direction parallel to the movement of a sliding plate while remaining free to expand in a direction perpendicular to the movement of the sliding plate in order to compensate for thermal expansion.

SUMMARY OF THE INVENTION

It is therefore an object of the present invention to develop a sliding gate valve which may reliably lock a lid against movement in a direction parallel to movement of a sliding plate while remaining free to move in a direction perpendicular to the movement of the sliding plate.

The above identified object is accomplished through a valve assembly which includes a sliding plate sandwiched between two fixed plates. The three plates are contained within a housing and are immobilized by a lid. The lid, in turn, is locked in place by a lock mounted to the housing. The lock prevents movement of the lid in a direction parallel to movement of the sliding plate while allowing for movement of the lid perpendicular to movement of the sliding plate. In one embodiment of the invention, the lock includes a pin and at least one spiral-shaped cam having a radius which increases as the pin is rotated from an unlocked to a locked position. Thus, an outer periphery of the cam is spaced apart from the lid when the lock is in an unlocked position and the outer periphery of the cam abuts the lid when the lock is in a locked position.

In a second embodiment of the present invention the lock includes a cylindrical pin with at least one cylindrical increased diameter portion. The cylindrical increased diameter portion has an axis which is eccentrically mounted or, in other words, not coaxially aligned with an axis of the cylindrical pin. Thus, as the cylindrical pin is rotated between unlocked and locked positions the outer periphery of the cylindrical increased diameter portion is moved from a position which is spaced apart from the lid and a position in which the outer periphery abuts the lid.

In addition, a lever may be provided on the lock. The lever is used to rotate the pin and moves between a horizontal position, in which the lock assumes the locked position, and a non-horizontal position, in which the lock assumes the unlocked position. By placing the lever at an upper portion of the housing, engagement of the valve assembly with a vessel necessarily requires that the lever assume the horizontal position, thus assuring that the lid is locked whenever the valve assembly is attached to the vessel.

In yet another embodiment of the invention, a plurality of locking elements are pivotally mounted onto the housing and extend such that the locking elements are able to engage opposite sides of an upper surface of the lid. The locking elements are, for example, pivotal clamping bolts which swing into reduced thickness portions located in the lid and thus are used to secure the plates within the housing.

Accordingly, the present invention overcomes the previously described problems of the prior art through a valve assembly which prevents movement of a lid in a direction parallel the movement of a sliding plate while allowing for movement of the lid in a direction perpendicular to movement of the sliding plate.

BRIEF DESCRIPTION OF THE DRAWINGS

Exemplary embodiments and further advantages of the invention will be described in more detail with reference to the drawings, in which.

DESCRIPTION OF THE PREFERRED EMBODIMENTS

Figure 1:
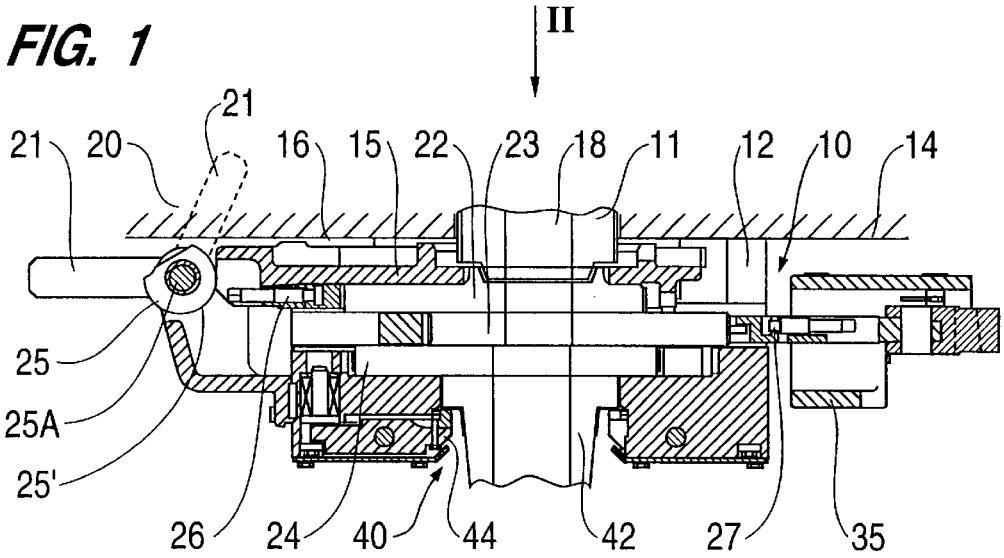
FIG. 1 is a section view of a sliding gate valve with a pouring tube changing device according to the invention.

Referring to FIG. 1, a sliding gate valve 10 is shown mounted to an outlet on the bottom of a vessel 14 containing a molten metal. The sliding gate valve 10 is connected to a sleeve 11 of the vessel 14. Although the vessel is preferably a tundish or a continuous casting installation, any device suitable for containing molten metal may be used. A pouring tube changing device 40 is provided on a lower portion of the sliding gate valve 10. The pouring tube changing device 40 holds a refractory pouring tube 42 which extends into a continuing casting mold and thus enables submerged pouring of the molten metal from the tundish into the mold.

The sliding gate valve 10 includes a housing 12 which is removably fastened to the vessel 14. To facilitate fastening, the housing 12 has projected engagement surfaces 16 formed on an upper surface which engage with an outer steel shell of the vessel 14. Located with the housing 12 are an upper fixed refractory valve plate 22, a lower fixed refractory valve plate 24, and a sliding plate 23 slidably located between the two fixed plates. A lid 15 is pivotally mounted to an upper portion of the housing 12 to secure the plates 22, 23, 24 within the housing 12. A fastening device 26 fastens fixed plates 22, 24 in position within lid 15 and housing 12. A metal frame 27 secures the sliding plate 23. The metal frame 27 is coupled to an actuator (not shown in detail) which is used to slide the sliding plate 23. The plates 22, 23, 24 each have a flow opening 18 through which molten metal may be poured out of vessel 14. The actuator is used to slide the sliding plate 23 from a position in which the flow openings of plates 22 and 24 are able to communicate with one another through the flow opening of sliding plate 23, and a position where the flow openings of plates 22 and 24 are blocked by a solid portion of sliding plate 23. Consequently, sliding plate 23 may be used as throttle or as a control element for controlling the volume of molten metal poured from the vessel 12 by varying the distance moved by the sliding plate 23.

The pouring tube 42 is provided in the changing device 40 and is arranged to adjoin the lower fixed plate 24. To this end, rocker arms 44 are used to press pouring tube 42 against the lower fixed plate 24. An actuator (not shown) may be used to remove the pouring tube 42 and thus allow replacement with a new pouring tube.

As mentioned above, lid 15 is pivotally mounted to an upper portion of the housing 12. Furthermore, the lid 15 is pivotally mounted about an axis 15*a* on a peg 39 located in housing 12. A handle 34 is mounted on lid 15 on a side opposite pivotal axis 15*a,* which may be used to open the lid. Upon removal of the sliding gate valve 10 from the vessel 14, lid 15 may be opened by lifting handle 34 such that lid 15 rotates about axis 15*a,* thus allowing replacement of valve plates 22, 23, 24. Hence, it is evident that as the lid 15 is provided on an upper portion of the housing, the sliding gate valve 10 must be removed from the vessel 14 in order to replace the valve plates.

A lock 20 is provided on an upper portion of the housing 12 for locking the lid 15.

When engaged, the lock 20 is designed to prevent movement of the lid 15 in a direction parallel to movement of the sliding plate 23 while permitting movement or expansion of the lid 15 in a direction perpendicular to movement of the sliding plate 23. More specifically, when engaged, lock 20 allows for thermal expansion of lid 15 in a direction perpendicular to a plane which is parallel to lid 15. To this end, the lock 20 includes a cylindrical pin 29 which is rotatably mounted, about an axis 25*a,* to housing 12. At least one cam 25, and in this instance two cams 25, are provided on and rotate together with pin 29. The cams 25 have an outer wall 25' which is defined by a radius, measured from axis 25*a* to outer wall 25', which increases, spirally, from a radius which is spaced apart from the lid 15 to a radius which abuts lid 15. A lever 21 is fixedly connected to pin 29 and is used to rotate lock 20. Lever 21 is positioned on pin 29 such that when lever 21 assumes a horizontal position, outer wall 25' abuts with and clamps lid 15.

In contrast, as lever 21 is rotated away from the horizontal position, the outer wall 25' also rotates so that lock 20 disengages from lid 15. Thus, when lock 20 is locked, the lever 21 is in a horizontal position and the particular radius of cam 25 aligned with lid 15 is large enough so that cam 25 engages with lid 15. Conversely, when lock 20 is unlocked, lever 21 is in a non-horizontal position and the particular radius of cam 25 aligned with lid 15 is small enough so that outer wall 25' is spaced apart from lid 15. In addition, although the figures indicate that a spiral-shaped cam is to be coaxially provided on cylindrical pin 29, the same effect may be accomplished by using a cylindrical cam mounted eccentrically on pin 29.

Lever 21 is designed to be moved by hand and possesses a length large enough so that it cannot assume a substantially vertical or open position 21' when sliding gate valve 10 has been mounted onto vessel 14. Thus, the bottom portion of vessel 14 ensures that lever 21 assumes a horizontal position whenever slidingly gate valve 10 is engaged with vessel 14. As a result, whenever sliding gate valve 10 is engaged with a vessel, lock 20 will necessarily assume a locked position. Furthermore, it is possible to design lever 21 with a weight large enough so that lever 21 assumes the horizontal position under its own weight. Hence under this design, upon being released by a user, lever 21 automatically engages and locks lid 15 into place.

A pair of protrusions 38 are provided on the bottom side of lid 15. The protrusions 38 engage with corresponding grooves formed in housing 12 when the lid 15 is closed. The combination of protrusions 38 and grooves engage in a nearly clearance-free manner and thus center lid 15 in the direction of movement of plate 23.

It A mounting 35 is provided on the housing 12 on a side opposite lock 20. The mounting 35 contains the sliding plate actuator and is mounted onto the housing via a hinge 36 such that mounting 35 is capable of being rotated away from housing 12. In addition, knob 37 is provided on mounting 35 and may be used to secure the free end of mounting 35 to housing 12.

Figure 2:
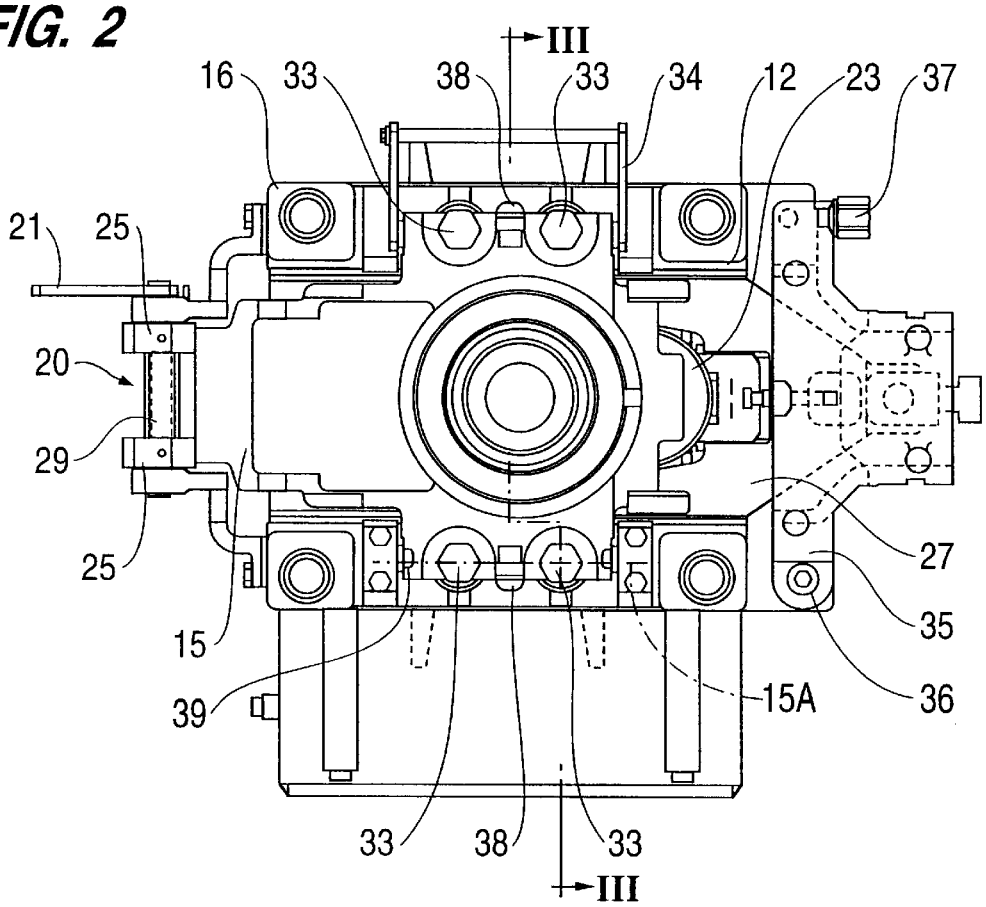
FIG. 2 is a top side plan view of the sliding gate valve of FIG. 1.
Figure 3:
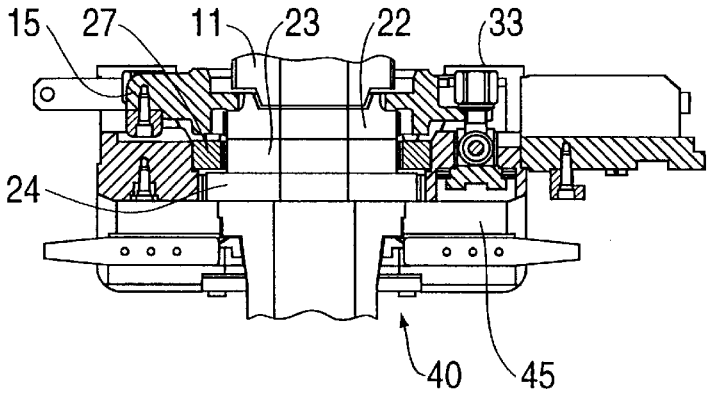
FIG. 3 is a section view of the sliding gate valve along the line III—III of FIG. 2.

Referring to FIGS. 2 and 3, several locking elements 33 are provided on opposite sides of lid 15. The locking elements 33 are used to secure the lid 15 to the housing 12 and are preferably pivotal clamping bolts having a lower end pivotally attached to the housing 12. An upper end of each clamping bolt may be rotated about its lower end and into a recess, or a reduced thickness portion, formed on the upper surface of the lid 15. The locking elements 33 may then be tightened, thus asserting a clamping force on the lid 15 as well as plates 22, 23, 24.

Clamping bolts 33 are mounted in a cut-out region located at a lower portion of the housing 12. The cut-out region of the housing resembles an elongate opening 45 or slot which is formed transverse to the direction of movement of the sliding plate 23 and extends from one side to another. Additionally, the elongate opening 45 is designed to receive an upper plate shaped end of the pouring tube 42.

Figure 4:
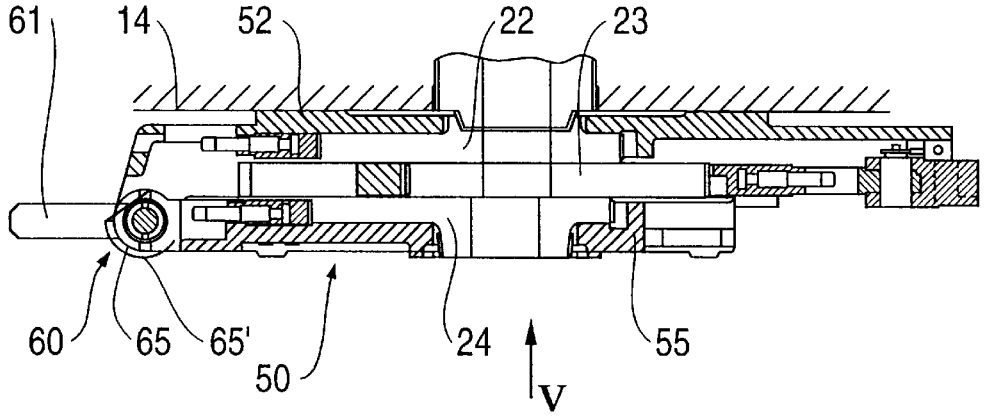
FIG. 4 is a section view of a second embodiment of a sliding gate valve in accordance with the invention in which the lid is disposed on the lower side of the device.
Figure 5:
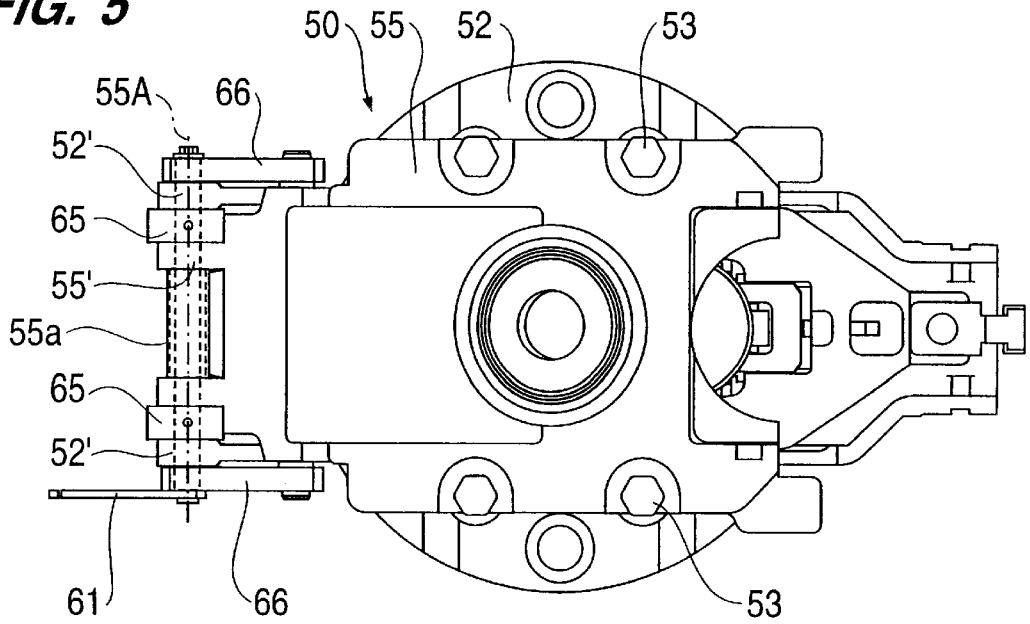
FIG. 5 is a bottom side plan view of the sliding gate valve of FIG. 4.

An alternate embodiment of a sliding gate valve of the present invention is shown in FIGS. 4 and 5. The construction of sliding gate valve 50 is similar to the embodiment shown in FIG. 1 and thus only the features differing between the two embodiments will be discussed. Initially, an important feature of sliding gate valve 50 is the omission of the pouring tube changing device. Accordingly, lid 55 is mounted to a bottom side of housing 52 with its pivotal axis 55A extending transverse to the direction of movement of sliding plate 23.

Similar to the embodiment shown in FIG. 1, a lock 60 is provided to immobilize lid 55. The lock 60 is provided with cams 65, which are secured to a pin 55*a* in the same manner as in the embodiment of FIG. 1. Pin 55*a* is rotatably mounted to bearings 52', which are provided on housing 52, and has a pivotable lever 61, which locks lid 55 when it assumes a horizontal position.

In addition, lid 55 is mounted on the same pin 55*a* as that of lock 60. For this purpose, lid 55 includes a bearing 55' through which pin 55*a* extends. Finally, guide levers 66, which connect lid 55 with pin 55*a,* and clamping bolts 53, which lock lid 55 to housing 52 are also provided.

The instant invention has thus been disclosed in connection with specific embodiments. However, it will be apparent to those skilled in the art that variations for the illustrated embodiments may be taken without departing from the spirit and scope of the invention. Therefore, all modifications and equivalent arrangements must be considered as being included within the scope of the invention.

What is claimed:

1. An assembly, comprising:

a housing;

a valve member, located within said housing, moveable in a direction of movement;

a lid pivotally mounted to said housing; and a lock, mounted to said housing, having an unlocked position and a locked position in which said lid is prevented from moving parallel to said direction of movement but is permitted to move in a direction perpendicular to said direction of movement;

wherein said lock is comprised of a pin and at least one cam formed thereon such that said lock is rotatable between said unlocked position in which an outer periphery of said at least one cam is spaced apart from said lid and said locked position in which said outer periphery of said at least one cam abuts said lid.

2. The assembly of claim 1, wherein:

an axis of said at least one cam is co-linear with an axis of said pin; and said outer periphery of said at least one cam is spirally shaped such that a radius, measured from said axis of said at least one cam to said outer periphery, increases as said lock moves from said unlocked position to said locked position.

3. An assembly, comprising:

a housing;

a valve member, located within said housing, moveable in a direction of movement;

a lid pivotally mounted to said housing; and a lock, mounted to said housing, having an unlocked position and a locked position in which said lid is prevented from moving parallel to said direction of movement but is permitted to move in a direction perpendicular to said direction of movement;

wherein said lock is comprised of a pin and at least one cam co-linearly formed thereon; and wherein an outer periphery of said at least one cam is spirally shaped such that a radius, measured from said axis of said at least one cam to said outer periphery, increases as said lock moves from said unlocked position to said locked position.

4. An assembly, comprising:

a housing;

a valve member, located within said housing, moveable in a direction of movement;

a lid pivotally mounted to said housing; and a lock, mounted to said housing, having an unlocked position and a locked position in which said lid is prevented from moving parallel to said direction of movement but is permitted to move in a direction perpendicular to said direction of movement;

wherein said lock is comprised of a cylindrical pin and at least one cylindrical increased diameter portion formed thereon such that said at least one cylindrical increased diameter portion is eccentrically aligned with said cylindrical pin; and wherein said cylindrical pin is rotatable between said unlocked position in which an outer periphery of said at least one cylindrical increased diameter portion is spaced apart from said lid, and said locked position in which said outer periphery of said at least one cylindrical increased diameter portion abuts said lid.

5. An assembly, comprising:

a housing;

a valve member, located within said housing, moveable in a direction of movement;

a lid pivotally mounted to said housing; and a lock, mounted to said housing, having an unlocked position and a locked position in which said lid is prevented from moving parallel to said direction of movement but is permitted to move in a direction perpendicular to said direction of movement;

wherein said lock further comprises a lever radially movable between a substantially horizontal position, in which said lock assumes said locked position, and a non-horizontal position, in which said lock assumes said unlocked position.

6. The assembly of claim 5, wherein:

a length of said lever is greater than a distance measured from a point where said lock is mounted to said housing to a point located on a surface of said assembly to be mounted to the vessel.

7. The assembly of claim 5, wherein:

said lever has a weight large enough so that said lock assumes said locked position by virtue of said weight.

8. The assembly of claim 1, wherein:

said locked position allows said lid to move in a direction perpendicular to a plane parallel to said lid.

9. The assembly of claim 1, wherein:

said lid pivotally opens about an axis which is parallel to the direction of movement of said valve.

10. The assembly of claim 1, wherein:

said lid pivotally opens about an axis which is transverse to the direction of movement of said valve.

11. The assembly of claim 10, wherein:

said lock further comprises a pin which is coaxial with the axis about which said lid pivotally opens.

12. The assembly of claim 1, further comprising:

a plurality of locking elements, pivotally mounted on and extending from said housing such that said plurality of locking elements engage two opposite sides of said lid, to lock said lid to said housing and to exert a clamping force on said valve.

13. The assembly of claim 12, wherein:

said plurality of locking elements comprises clamping bolts having a first end pivotally attached to said housing and a second end removably attached to said lid.

14. The assembly of claim 13, wherein:

said lid includes a plurality of reduced thickness portions to receive said second ends of said plurality of locking elements.

15. An arrangement for a valve, comprising:

a housing having a cavity shaped to receive a valve member such that said cavity allows the valve member, when the valve member is received by sad cavity, to move in a direction of movement;

a lid pivotally mounted to said housing; and a lock, mounted to said housing, having an unlocked position and a locked position in which said lid is prevented from moving parallel to said direction of movement but is permitted to move in a direction perpendicular to said direction of movement;

wherein said lock is comprised of a pin and at least one cam formed thereon such that said lock is rotatable between said unlocked position in which an outer periphery of said at least one cam is spaced apart from said lid and said locked position in which said outer periphery of said at least one cam abuts said lid.

16. The arrangement of claim 15, wherein:

an axis of said at least one cam is co-linear with an axis of said pin; and said outer periphery of said at least one cam is spirally shaped such that a radius, measured from said axis of said at least one cam to said outer periphery, increases as said lock moves from said unlocked position to said locked position.

17. An arrangement for a valve, comprising:

a housing having a cavity shaped to receive a valve member such that said cavity allows the valve member, when received by said cavity, to move in a direction of movement;

a lid pivotally mounted to said housing; and a lock, mounted to said housing, having an unlocked position and a locked position in which said lid is prevented from moving parallel to said direction of movement but is permitted to move in a direction perpendicular to said direction of movement;

wherein said lock is comprised of a pin and at least one cam co-linearly formed thereon; and wherein an outer periphery of said at least one cam is spirally shaped such that a radius, measured from said axis of said at least one cam to said outer periphery, increases as said lock moves from said unlocked position to said locked position.

18. An arrangement for a valve, comprising:

a housing having a cavity shaped to receive a valve member such that said cavity allows the valve member, when received by said cavity, to move in a direction of movement;

a lid pivotally mounted to said housing: and a lock, mounted to said housing, having an unlocked position and a locked position in which said lid is prevented from moving parallel to said direction of movement but is permitted to move in a direction perpendicular to said direction of movement;

wherein said lock is comprised of a cylindrical pin and at least one cylindrical increased diameter portion formed thereon such that said at least one cylindrical increased diameter portion is eccentrically aligned with said cylindrical pin; and wherein said cylindrical pin is rotatable between said unlocked position in which an outer periphery of said at least one cylindrical increased diameter portion is spaced apart from said lid and said locked position in which said outer periphery of said at least one cylindrical increased diameter portion abuts said lid.

19. An arrangement for a valve, comprising:

a housing having a cavity shaped to receive a valve member such that said cavity allows the valve member, when received by said cavity, to move in a direction of movement;

a lid pivotally mounted to sad housing; and a lock, mounted to said housing, having an unlocked position and a locked -position in which said id is prevented from moving parallel to said direction of movement but is permitted to move in a direction perpendicular to said direction of movement;

wherein said lock further comprises a lever radially movable between a substantially horizontal position, in which said lock assumes said locked position, and a non-horizontal position in which said lock assumes said unlocked position.

20. The arrangement of claim 19, wherein:

a length of said lever is greater than a distance measured from a point where said lock is mounted to said housing to a point located on a surface of said assembly to be mounted to the vessel.

21. The arrangement of claim 19, wherein:

said lever has a weight large enough so that said lock assumes said locked position by virtue of said weight.

22. The arrangement of claim 15, wherein:

said locked position allows said lid to move in a direction perpendicular to a plane parallel to said lid.

23. The arrangement of claim 15, wherein:

said lid pivotally opens about an axis which is parallel to the direction of movement of said valve.

24. The arrangement of claim 15, wherein:

said lid pivotally opens about an axis which is transverse to the direction of movement of said valve.

25. The arrangement of claim 24, wherein:

said lock further comprises a pin which is coaxial with the axis about which said lid pivotally opens.

26. The arrangement of claim 15, further comprising:

a plurality of locking elements, pivotally mounted on and extending from said housing such that said plurality of locking elements engage two opposite sides of said lid, to lock said lid to said housing.

27. The arrangement of claim 26, wherein:

said plurality of locking elements comprises clamping bolts having a first end pivotally attached to said housing and a second end removably attached to said lid.

28. The arrangement of claim 27, wherein:

said lid includes a plurality of reduced thickness portions to receive said second ends of said plurality of locking elements.

* * * * *